US005948324A

United States Patent [19]

Cook

[11] Patent Number: 5,948,324

[45] Date of Patent: Sep. 7, 1999

[54] FLOW THROUGH HUMIDIFIER

[75] Inventor: Kenneth J. Cook, Troy, Mich.

[73] Assignee: Lobb Company, Troy, Mich.

[21] Appl. No.: 08/859,673

[22] Filed: May 20, 1997

[51] Int. Cl.[6] ..... B01F 3/04

[52] U.S. Cl. ..... 261/36.1; 261/37; 261/66; 261/106

[58] Field of Search ..... 261/36.1, 37, 66, 261/103, 106, DIG. 15, DIG. 74

[56] References Cited

U.S. PATENT DOCUMENTS

| | | | |
|---|---|---|---|
| 2,948,233 | 8/1960 | Scharfe | 261/36.1 |
| 3,034,771 | 5/1962 | Harris | 261/36.1 |
| 3,119,887 | 1/1964 | Baehr | 261/36.1 |
| 3,265,371 | 8/1966 | McGrath | 261/36.1 |
| 3,904,393 | 9/1975 | Morse . | |
| 4,125,576 | 11/1978 | Kozinski . | |
| 4,211,735 | 7/1980 | Berlin . | |
| 4,215,079 | 7/1980 | Christophersen et al. | 261/36.1 |
| 4,350,646 | 9/1982 | Baus . | |
| 4,354,985 | 10/1982 | Johnson . | |
| 4,361,522 | 11/1982 | Goettl . | |
| 4,994,211 | 2/1991 | Fuller . | |
| 5,075,047 | 12/1991 | Youngeberg . | |
| 5,143,655 | 9/1992 | Chiu et al. . | |
| 5,203,505 | 4/1993 | Yum . | |
| 5,211,891 | 5/1993 | Anoszko . | |
| 5,226,935 | 7/1993 | Wolff et al. . | |
| 5,368,784 | 11/1994 | Annestedt, Sr. . | |

OTHER PUBLICATIONS

Lobb FT–20 Humidifier Instructions.

Lobb Power Humidifier, Model WA–1 Plenum Type and WA–2 Plenum Type, Installation and Operation Instructions.

*Primary Examiner*—C. Scott Bushey

*Attorney, Agent, or Firm*—Bliss McGlynn, P.C.

[57] ABSTRACT

A flow through humidifier includes a media, a water supply assembly to supply inlet water from a source to the media, a collector to collect unevaporated water from the media, and a reflow pump to pump the unevaporated water from the collector and to combine the unevaporated water with the inlet water from the water supply assembly, thus enabling more water to pass over the media for evaporation.

9 Claims, 2 Drawing Sheets

FLOW THROUGH HUMIDIFIER

BACKGROUND OF THE INVENTION

1. Field of the Invention

The present invention relates generally to humidifiers and, more particularly, to a flow through humidifier.

2. Description of the Related Art

It is known to provide humidifiers for furnaces such as of the forced hot air type. One example of such a humidifier is a flow through humidifier. The flow through humidifier typically includes a housing mounted to a warm air plenum or return air plenum of the furnace and a water evaporation media such as an evaporative pad disposed within the housing. The flow through humidifier also includes a water supply assembly disposed within the housing to supply water to the media. The water supply assembly includes a solenoid-actuated valve having an inlet fluidly connected to a water line and electrically connected to a humidistat for control thereof. The water supply assembly also includes a flow restrictor on the outlet side of the valve and a water tube connected to the flow restrictor. The humidistat controls external power to the solenoid-actuated valve controlling the supply of water from the water line through the flow restrictor and through the water supply tube to the media. The water from the water supply tube flows into a water distribution tray at the top of the media which distributes the water over the media. The water flows over the media and with air passing through the media, facilitating evaporation of the water, thereby increasing the humidity of the air. Unevaporated water is collected in a drain pan at the bottom of the media. A drain tube is connected to the drain pan, thus allowing the unevaporated water to discharge or exit the housing of the humidifier to a local drain.

The main disadvantage of this type of humidifier is that the supply water passes over the media only once and the relatively large amount of unevaporated water is discharged as waste.

SUMMARY OF THE INVENTION

It is, therefore, one object of the present invention to provide a flow through humidifier which reuses unevaporated water.

It is another object of the present invention to provide a flow through humidifier which uses less water.

It is yet another object of the present invention to provide a flow through humidifier with a reflow pump.

It is another object of the present invention to provide a flow through humidifier with a reflow pump that possess its own flow restrictor.

It is a further object of the present invention to provide a flow through humidifier with a reflow pump that has no moving parts.

To achieve the foregoing objects, the present invention is a flow through humidifier including a media and a water supply assembly to supply inlet water from a source to the media. The flow through humidifier also includes a collector to collect unevaporated water from the media and a reflow pump to pump the unevaporated water from the collector and combine the unevaporated water with the inlet water from the water supply assembly, thus enabling more water to pass over the media for evaporation.

One advantage of the present invention is that a new flow through humidifier is provided. Another advantage of the present invention is that the flow through humidifier includes a reflow pump to recirculate and reuse unevaporated water that has previously flowed over the media. Yet another advantage of the present invention is that the flow through humidifier presents more water for evaporation to the media and discharges less water by its reflow action. Still another advantage of the present invention is that the flow through humidifier has a one-piece reflow pump, thereby eliminating any moving pump parts.

Other objects, features and advantages of the present invention will be readily appreciated as the same becomes better understood after reading the subsequent description when considered in connection with the accompanying drawings.

DESCRIPTION OF THE PREFERRED EMBODIMENT(S)

Figure 1:
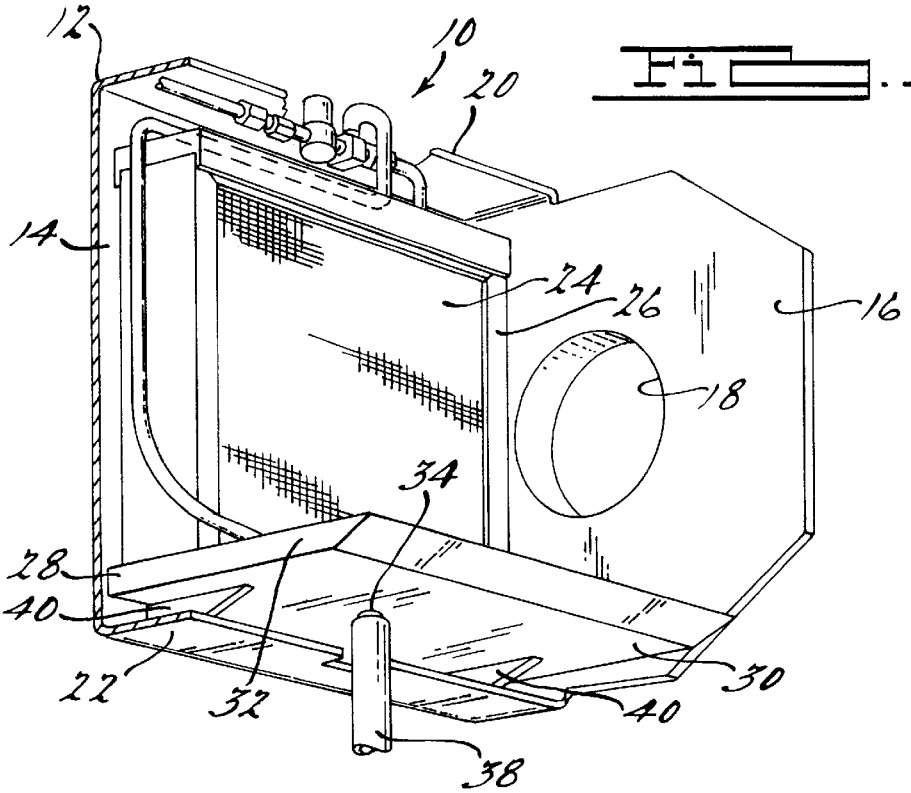
FIG. 1 is a fragmentary perspective view of a flow through humidifier according to the present invention.

Referring to FIG. 1, one embodiment of a flow through humidifier 10, according to the present invention, is illustrated for use with a furnace such as a fan assisted combustion gas furnace (not shown). The flow through humidifier 10 includes a housing 12 to be mounted on either a warm air plenum or cold air plenum of the furnace as is known in the art. The housing 12 has a base wall 14 with an aperture (not shown) which is aligned with a corresponding aperture in the warm air plenum or cold air plenum and is secured thereto by suitable means such as fasteners (not shown). The housing 12 also includes a pair of side walls 16 spaced transversely and extending outwardly generally perpendicularly from the base wall 14. One of the side walls 16 has an aperture 18 extending therethrough for connection by a duct (not shown) to the other one of the warm air plenum or cold air plenum. The housing 12 further includes a top wall 20 and bottom wall 22 extending generally perpendicularly from the base wall 14 for connection to a cover (now shown). The base wall 14, side walls 16, top wall 20 and bottom wall 22 are integral, unitary and formed as one piece. It should be appreciated that the housing 12 is conventional and known in the art.

The flow through humidifier 10 also includes a water evaporation media 24 disposed within the housing 12. The media 24 is a generally rectangular shaped evaporative pad which is conventional and known in the art. The media 24 includes a frame 26 about its periphery. The frame 26 has an aperture (not shown) in the top and bottom of the frame 26 to allow fluid to flow therethrough. The media 24 is suspended within the housing 12 by suitable means such as hooks (not shown). It should be appreciated that the hooks hang the frame 26 from the base wall 14.

Figure 2:
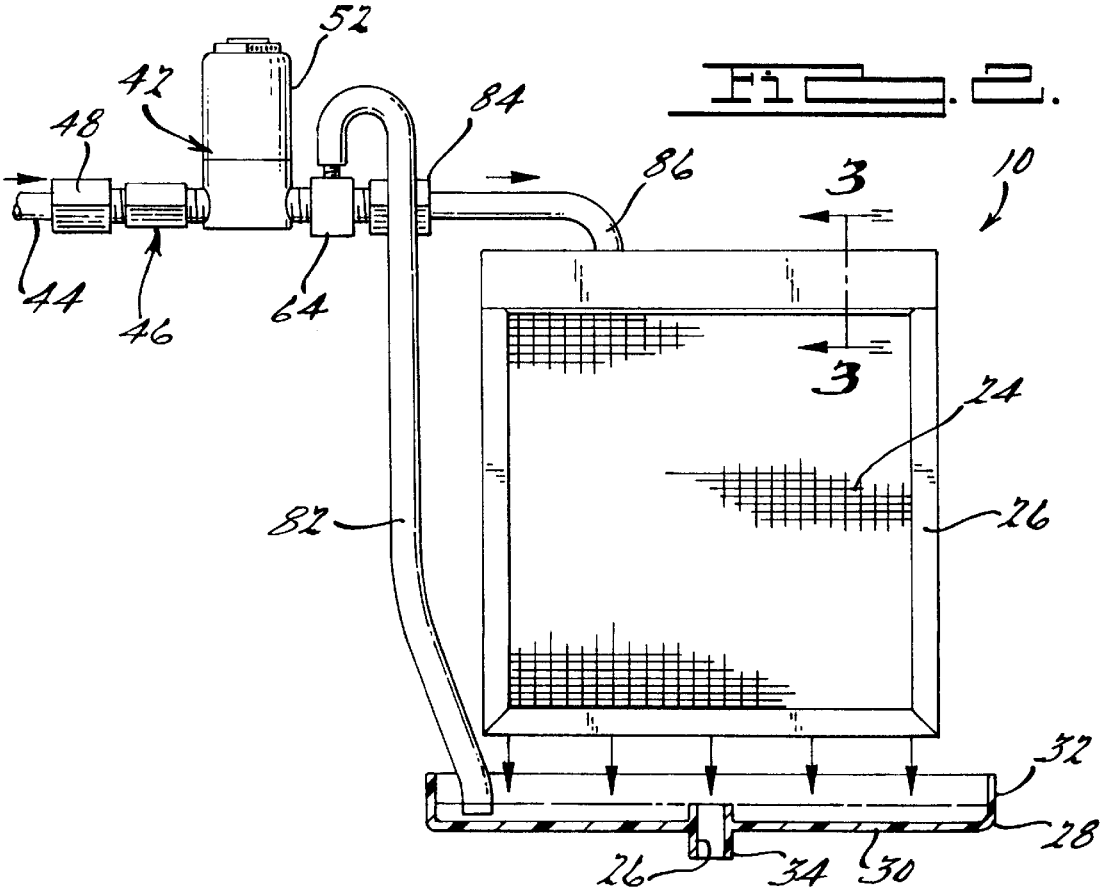
FIG. 2 is a fragmentary elevational view of the flow through humidifier of FIG. 1.

Referring to FIGS. 1 and 2, the flow through humidifier 10 includes a collector or drain pan 28 to collect unevaporated fluid from the media 24. The drain pan 28 is generally rectangular in shape and has a bottom wall 30 and a side wall 32 extending around and generally perpendicular to the bottom wall 30. The drain pan 28 includes a drain nipple 34 extending above the bottom wall 30 to a predetermined height above the bottom wall 30 and a predetermined distance below the bottom wall 30. The drain nipple 34 is a generally circular hollow tube having an aperture 36 extending therethrough. The drain pan 28 also includes a drain line or tube 38 connected to the drain nipple 34 by suitable means such as a spring clamp (not shown) to direct fluid from the drain nipple 34 to a floor drain (not shown). The drain pan 28 further includes a pair of transversely spaced feet 40 extending outwardly from the bottom wall 30 to contact the bottom wall 22 of the housing 12. It should be appreciated that the drain pan 28 is secured to the base wall 14 of the housing 12 by suitable means such as hooks (not shown). It should also be appreciated that the drain pan 28 may be attached to or part of media 24.

Figure 3:
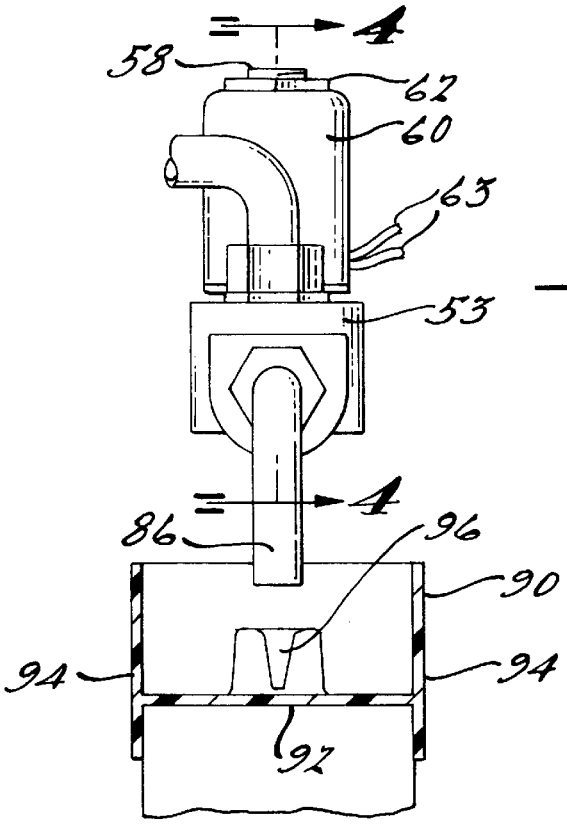
FIG. 3 is a sectional view taken along line 3—3 of FIG. 2.
Figure 4:
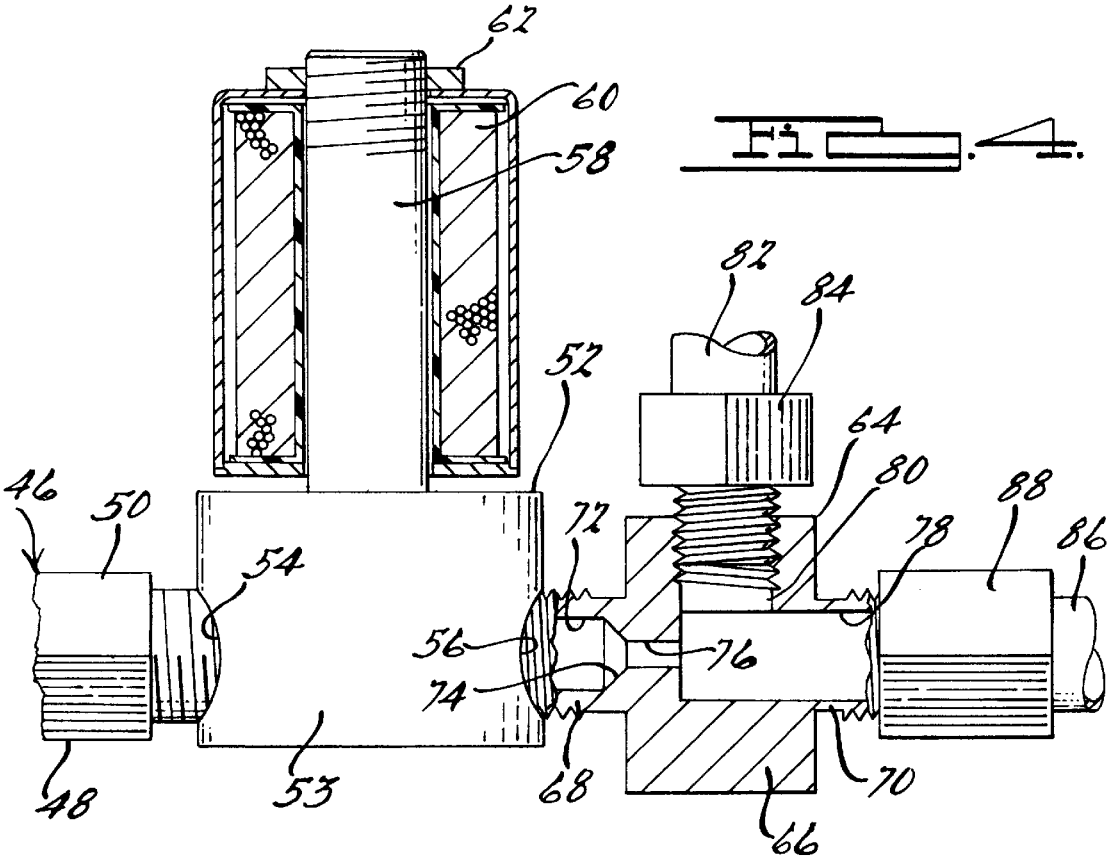
FIG. 4 is a sectional view taken along line 4—4 of FIG. 3.

Referring to FIGS. 2 through 4, the flow through humidifier 10 further includes a fluid or water supply assembly, generally indicated at 42, to supply fluid such as water to the media 24. The water supply assembly 42 includes an inlet line 44 connected to a source of fluid such as water (not shown). The water supply assembly 42 also includes a filter, generally indicated at 46, connected to the inlet line 44 by suitable means such as a fitting 48. The filter 46 has a housing 50 with an aperture (not shown) extending axially therethrough. The housing 50 is made of a metal material such as brass. The housing 50 is threaded at both axial ends for threaded engagement with the fitting 48 and a solenoid-actuated valve 52 to be described. The filter 46 also includes a screen (not shown) disposed within the aperture of the housing 50. The screen is generally conically shaped and has its enlarged end retained in an enlarged portion of the aperture. It should be appreciated that the screen filters small particulate matter in the inlet water before entering the solenoid-actuated valve 52.

The water supply assembly 42 includes a solenoid-actuated valve 52 connected to the filter 46 to control the flow of inlet water from the inlet line 44 to the media 24. The solenoid-actuated valve 52 has a cylindrical base 53 with an inlet cavity 54 which is threaded for engagement with a threaded end of the housing 50. The base 53 also has an outlet cavity 56 which is threaded. The base 53 includes a valve (not shown) which opens a passage (not shown) between the inlet cavity 54 and outlet cavity 56. The passage has a predetermined diameter such as 3⁄32 inches. The solenoid-actuated valve 52 includes a valve spring assembly 58 extending axially from the base 53 and a solenoid 60 disposed over the mounting post 58. The solenoid-actuated valve 52 includes a nut 62 to engage a threaded end of the valve spring assembly 58 to prevent the solenoid 60 from exiting the valve spring assembly 58. The solenoid 60 is electrically connected by wires 63 to a humidistat (not shown) which supplies power to the solenoid 60 only when the furnace fan is ON and the humidity of the ambient air is below a predetermined level. The solenoid 60 creates a magnetic field in response to power supplied thereto to move the valve toward the solenoid 60 and open the passage. When power is terminated to the solenoid 60, the magnetic field terminates and the valve returns to its original position to close the passage. It should be appreciated that the solenoid-actuated valve 52 is conventional and known in the art.

The flow through humidifier 10 includes a hydrostatic reflow pump 64 connected to the solenoid-actuated valve 52. The reflow pump 64 has a pump body 66 which is generally rectangular in shape and made of a metal material such as brass. The pump body 66 has an inlet end 68 extending axially and an outlet end 70 extending axially. The inlet end 68 is threaded for engagement with the outlet cavity 56 of the base 53. The inlet end 68 has an inlet cavity 72 extending axially and tapering at 74 to a restricted orifice or passage 76. The restricted passage 76 has a predetermined diameter in the range of approximately 0.010 inches to approximately 0.03125 inches, preferably 0.014 to 0.016 inches. The restricted passage 76 restricts inlet water to a minimum. The restricted passage 76 may be adjusted manually or electrically by structure (not shown).

The pump body 66 has an enlarged outlet cavity 78 extending axially from the restricted passage 76 through the outlet end 70. The pump body 66 also has a reflow cavity 80 extending generally perpendicularly to the outlet cavity 78 and communicating therewith. The reflow pump 64 includes a reflow tube or conduit 82 having one end extending into the drain pan 28 and the other end connected to a threaded fitting 84 which threadably engages the reflow cavity 80. It should be appreciated that the reflow conduit 82 may be connected to the drain pan 28.

The reflow pump 64 further includes a water supply tube or conduit 86 having one end connected to a threaded fitting 88 which threadably engages the outlet end 70 and another end disposed over the media 24. It should be appreciated that the restricted passage 76 acts as a flow restrictor. It should also be appreciated that the reflow pump 64 can be located anywhere in or out of the housing 12, but is preferably located at the bottom of the housing 12 to increase the efficiency of pumping by start of reflow action.

The flow through humidifier 10 also includes a fluid or water distribution tray 90 to distribute the water from the inlet valve or conduit 86 over the media 24. The water distribution tray 90 includes a base wall 92 having a generally rectangular shape and disposed adjacent the top of the frame 26 for the media 24. The distribution tray 90 also includes side walls 94 extending generally perpendicularly to the base wall 92 above and below the base wall 92 and about the periphery thereof. The distribution tray 90 also includes at least one, preferably a plurality of openings 96 extending thought the base wall 92. It should be appreciated that water from the inlet valve conduit 86 is dispensed in the water distribution tray 90 between the base wall 92 and side walls 94 and the openings 96 distribute the water through the base wall 92 and aperture in the frame 26 to the media 24.

In operation, the furnace fan blows air though the housing 12 and the media 24. When the furnace fan is on and the humidity of the ambient air is below a predetermined level, the humidistat supplies power to the solenoid-actuated valve 52. The solenoid-actuated valve 52 opens to allow inlet water from the inlet line 44 to flow through the filter 46, solenoid-actuated valve 52, pump 64 and water supply conduit 86 to the distribution tray 90. The distribution tray 90 distributes the water across the top of the media 24. The water flows down and across the media 24 and a portion of the water is evaporated by the air passing though the media 24. The unevaporated water from the media 24 is collected in the drain pan 28. The inlet water passing through the pump 64 creates a vacuum or pressurize difference in the reflow cavity 80 and reflow conduit 82 and atmospheric pressure pushes the unevaporated water from the drain pan 28 through the reflow conduit 82 and reflow cavity 80 where it is combined and mixed with the inlet water flowing from the restricted passage 76 to the outlet cavity 78. The mixed water flows through the outlet cavity 78 and water supply conduit 86 to the distribution tray 90 to repeat the cycle. It should be appreciated that excess unevaporated water in the drain pan 28 will exit the drain pan 28 once the water level exceeds the height of the drain nipple 34. It should also be appreciated that the reflow pump 64 recirculates the unevaporated water to allow more water to pass over the media 24 for evaporation in the same time period, but drawing less inlet water from the inlet line 44.

The present invention has been described in an illustrative manner. It is to be understood that the terminology which has been used is intended to be in the nature of words of description rather than of limitation.

Many modifications and variations of the present invention are possible in light of the above teachings. Therefore, within the scope of the appended claims, the present invention may be practiced other than as specifically described.

What is claimed is:

1. A flow through humidifier comprising:

a media;

a water supply assembly to supply inlet water from a source to said media;

a collector associated with said media to collect unevaporated water from said media;

a hydrostatic reflow pump having a pump body with an inlet end and an outlet end, said inlet end connected to said water supply assembly, said pump body having an inlet cavity at said inlet end and an enlarged outlet cavity at said outlet end, a restricted passage extending from said inlet cavity to said enlarged outlet cavity, and a reflow cavity extending generally perpendicular to and communicating with said enlarged outlet cavity past said restricted passage;

a conduit connected to said reflow cavity of said reflow pump and said collector;

said water supply assembly comprising a solenoid-actuated valve having an inlet and an outlet, a water inlet conduit operatively connected to said inlet to supply water to said valve, and a fluid outlet conduit extending to a top of said media and connected to said outlet cavity of said reflow pump and said reflow pump being connected to said outlet of said solenoid actuated valve, said conduit being connected to said reflow cavity to allow unevaporated water from said collector to be mixed with the inlet water in said enlarged outlet cavity downstream of said restricted passage.

2. A flow through humidifier as set forth in claim 1 wherein said collector has a base wall, a side wall extending around and generally perpendicular to said base wall, and a drain nipple extending a predetermined height above a plane of said base wall and a predetermined distance below a plane of said base wall, said base wall having an aperture therethrough to allow unevaporated water to exit said collector, and drain line connected to said drain nipple to direct unevaporated water from said drain nipple.

3. A flow through humidifier as set forth in claim 1 including a distribution tray associated with a top end of said media to distribute water over said media.

4. A flow through humidifier as set forth in claim 3 wherein said distribution tray has at least one aperture extending therethrough.

5. A flow through humidifier as set forth in claim 1 wherein said water supply assembly includes a water inlet conduit operatively connected to said inlet to supply water to said valve.

6. A flow through humidifier as set forth in claim 5 including a filter interconnecting said water inlet conduit and said inlet of said valve.

7. A flow through humidifier as set forth in claim 1 including a water supply conduit extending to a top of said media and connected to said reflow pump, said reflow pump being connected to said outlet.

8. A flow through humidifier as set forth in claim 1 wherein said restricted passage has a diameter in the range of approximately 0.010 inches to approximately 0.03125 inches.

9. A flow through humidifier comprising:

a media;

a water supply assembly to supply inlet water from a source to said media;

a drain pan associated with said media to collect unevaporated water from said media;

a hydrostatic reflow pump connected to said water supply assembly to pump the unevaporated water from said drain pan to said water supply assembly and to combine the unevaporated water with the inlet water;

said drain pan having a base and a drain nipple extending above a plane of said base and having an aperture therethrough to allow unevaporated water to exit said drain pan;

a conduit interconnecting said reflow pump and said drain pan;

a water distribution tray associated with a top end of said media to distribute the water over said media;

said water supply assembly comprising a solenoid-actuated valve having an inlet and an outlet, a water inlet conduit operatively connected to said inlet to supply water to said valve, a filter interconnecting said water inlet conduit and said inlet of said valve, and a water supply conduit extending to a top of said media and connected to said reflow pump and said reflow pump being connected to said outlet;

said reflow pump having a pump body with an inlet end and an outlet end, an inlet cavity at said inlet end and an enlarged outlet cavity at said outlet end, a restricted passage extending from said inlet cavity to said enlarged outlet cavity, said inlet cavity extending axially and tapering to said restricted passage, said restricted passage having a predetermined diameter in a range of approximately 0.010 inches to approximately 0.03125 inches to restrict inlet water to a minimum and a reflow cavity extending generally perpendicular to and communicating with said enlarged outlet cavity past said restricted passage, said enlarged outlet cavity extending axially from said restricted passage and being enlarged to a diameter greater than said restricted passage and said inlet cavity, said conduit being connected to said reflow cavity to allow unevaporated water from said drain pan to be mixed with the inlet water in said enlarged outlet cavity downstream of said restricted passage.

* * * * *